US005566649A

United States Patent [19]

Norris

[11] Patent Number: 5,566,649

[45] Date of Patent: Oct. 22, 1996

[54] METHOD AND APPARATUS FOR THE CLEANING OF FIRE TUBES IN A FIRE TUBE BOILER

[76] Inventor: Orlin Norris, P.O. Box 674, Chatham, N.J. 07928

[21] Appl. No.: 511,369

[22] Filed: Aug. 4, 1995

[51] Int. Cl.[6] ..... F22B 37/18

[52] U.S. Cl. ..... 122/379; 122/380; 122/393; 122/394; 122/396; 165/95

[58] Field of Search ..... 122/379, 380, 122/393, 394, 395, 396; 165/95

[56] References Cited

U.S. PATENT DOCUMENTS 4,624,220 11/1986 Olsson ..... 122/379
4,899,697 2/1990 Franklin et al. ..... 122/379
4,923,374 5/1990 Lundin et al. ..... 122/379
5,211,135 5/1993 Correia et al. ..... 122/379

*Primary Examiner*—Henry A. Bennett
*Assistant Examiner*—Siddharth Ohri
*Attorney, Agent, or Firm*—James W. Pemrick

[57] ABSTRACT

The present invention relates to a method and apparatus for cleaning and removing the buildup of products of corrosion, oxidation, sedimentation and comparable chemical reactions from various portions of a fire tube boiler. Specific areas to be cleaned are the surfaces of the fire tubes, crevices, and junctions inside the boiler. Also cleaned is the location where the fire tube boiler comes into contact with the tube sheets, boiler shell and fire tubes. One or a plurality of ultrasonic transducers are placed inside the boiler and activated to transmit ultrasonic energy at a sufficient amplitude and frequency to dislodge deposits, sedimentation and sludge from the interior surfaces of the boiler.

9 Claims, 1 Drawing Sheet

METHOD AND APPARATUS FOR THE CLEANING OF FIRE TUBES IN A FIRE TUBE BOILER

BACKGROUND OF THE INVENTION

1. Field of the Invention

The present invention relates to ultrasonic cleaning of boilers, and more particularly to a method and apparatus for the ultrasonic cleaning of boiler tubes, tube sheets and the interior surfaces of horizontal/vertical fire tube boilers.

2. Description of the Background Art

The accumulation of deposits on the interior of a horizontal/vertical fire tube boiler, which hereafter will be referred to as a boiler, is a common occurrence. It is well known that chemical cleaning to remove the deposits accumulated inside the boiler is extremely time consuming, expensive and harmful to the environment.

Ultrasonic cleaners have existed for a period of time and have been used in numerous applications in various fields. See for example U.S. Pat. No. 4,375,911, issued to Samuel L. Sachs and Freeman K. Hill on Mar. 8, 1983. This patent discloses an ultrasonic cleaning method and apparatus to remove bio-fouling of heat exchangers in an ocean thermal energy conversion plant.

A previous method for cleaning boiler tubes was by brushing or scraping the tubes. Some of the deposits and sludge would be removed, but this proved to be highly ineffective, time consuming, labor intensive and expensive.

It is the purpose of the present invention to overcome the disadvantages of the prior an by disclosing an improved method and apparatus for the ultrasonic cleaning of fire tubes and the interior surfaces in a boiler.

SUMMARY OF THE INVENTION

The present invention was made in order to solve the previous problems of the prior art, and it is an object of the present invention to provide a method and apparatus for the ultrasonic cleaning of fire tubes in a boiler.

An object of the present invention is to provide a method for cleaning the interior surfaces and fire tubes of a boiler which is safe for the environment.

Another object of the present invention is to provide an ultrasonic cleaning system for cleaning fire tubes and the interior surfaces of a boiler.

Another object of the present invention is to provide an ultrasonic cleaning apparatus which is easily calibrated, portable and readily serviceable.

A further object of the present invention is to provide an ultrasonic cleaning apparatus which is simple in design, inexpensive to manufacture, rugged in construction, easy to use and efficient in operation.

Yet another object of the present invention is to provide an ultrasonic cleaning apparatus which is capable of being configured so that it may be deployed in a relatively narrow space.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The present invention will be more fully understood by reference to the following detailed description thereof when read in conjunction with the attached drawings, and wherein.

DETAILED DESCRIPTION OF THE PREFERRED EMBODIMENTS

Figure 1:
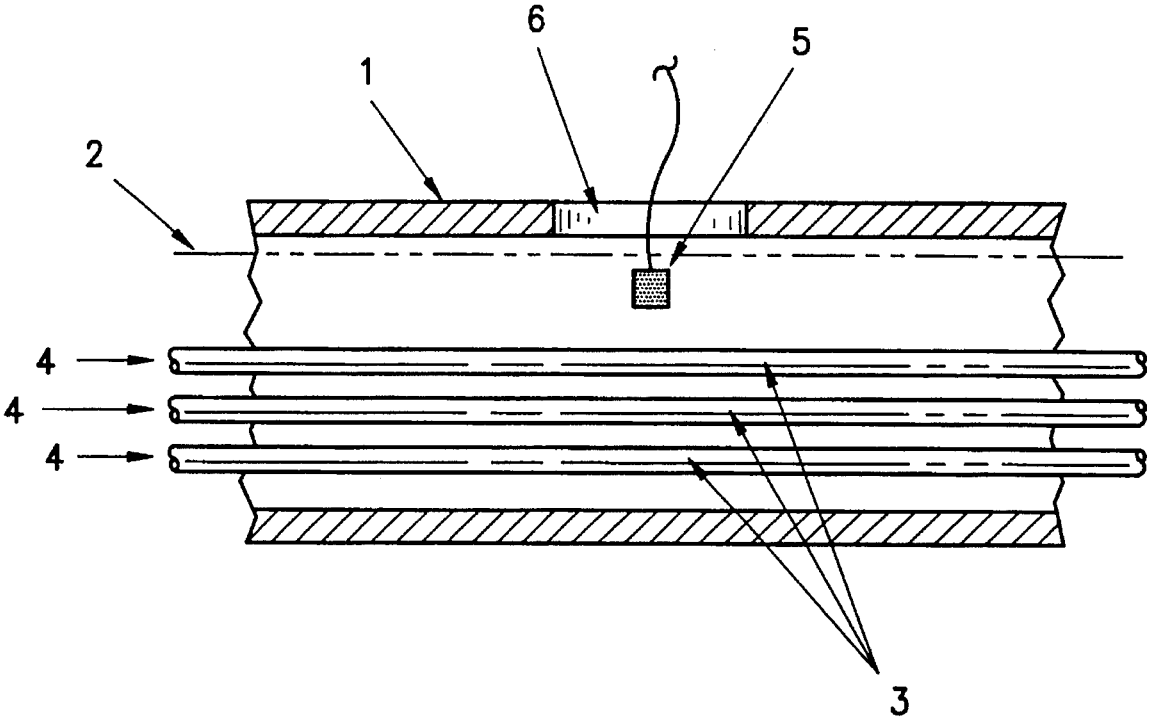
FIG. 1 is a side sectional view of a typical horizontal fire tube boiler illustrating the fire tubes, fluid level and ultrasonic transducer.

FIG. 1 illustrates the components of a fire tube boiler combined with the present invention. The boiler 1 includes an external casing or shell which has an opening 6. The opening 6 could be a manhole cover. The opening 6 permits access to the boiler, and the contents therein. The level of the water or fluid inside the boiler is illustrated by numeral 2. A plurality of fire tubes 3 are shown passing through the boiler 1. These tubes 3 carry the gasses, indicated by numeral 4, which heat the water or fluid inside the boiler 1.

Only three fire tubes 3 are shown in the drawing, but it will be understood that the typical boiler has a large number of these tubes to heat the water. The water in the boiler can also be replaced by other fluids, such as, chemicals, water and chemical mixtures, or other fluids well known in the art.

Ultrasonic transducer 5 is shown extended into the boiler 1 through opening 6. Only one transducer is shown, but it will be understood that many transducers 5 could be placed inside the boiler 1. The transducers could be placed on a boom in a series or parallel fashion or arranged in a circular or fan-shaped configuration. This group of ultrasonic transducers could then be inserted into the boiler 1. A single or group of transducers will herein be referred to as transducer 5. To clean the fire tubes 3 and interior surfaces of the boiler 1 the transducer 5 is placed below water level 2. The transducer 5 is activated and ultrasonic energy is directed at the fire tubes 3 and the interior surfaces. This ultrasonic energy cleans the tubes 3 by dislodging deposits and sludge that has accumulated over time inside boiler 1. The intensity and frequency of ultrasonic transducers is well known and will not be discussed in detail.

The present invention results in a very easy and portable method and apparatus for cleaning boilers and fire tubes. The ultrasonic transducer(s) can be easily placed inside the boiler through any suitable manhole cover or opening. More than one transducer can be placed through one opening or many transducers can be placed into many openings. The transducers 5 are easily activated and have proven effective to remove fire tube deposits and sludge. The transducers 5 are easily transported and manipulated, and a resulting benefit is that no harsh or dangerous chemicals are used for the cleaning process.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A method for cleaning fire tube boilers, where the boiler includes an outer shell having interior surfaces, a plurality of fire tubes and water at a predetermined level, comprising:

a plurality of ultrasonic transducers placed inside said boiler and below said water level, said plurality of ultrasonic transducers being inserted in a folded state and deployed in an expanded state inside said boiler, and simultaneously activating said plurality of ultrasonic transducers to a frequency so that ultrasonic energy is transmitted through said water to said fire tubes and said interior surfaces so that debris, deposits and sludge is removed.

2. An apparatus for cleaning the interior surfaces of fire tube boilers, where the boiler includes an outer shell having interior surfaces, a plurality of fire tubes and water at a predetermined level comprising:

a plurality of ultrasonic transducers placed on a foldable and deployable boom, said boom having a plurality of arms, each of said arms containing a plurality of ultrasonic transducers, said boom being deployable within the interior of said boiler so that the plurality of ultrasonic transducers, when energized, function to dislodge debris, deposits and sludge from the surfaces, cracks and crevices on the interior surface of said boiler.

3. The apparatus of claim 2 further comprising a boom having two parallel arms, each arm including a plurality of ultrasonic transducers, wherein said transducers are simultaneously operable to dislodge deposits from the interior surfaces of said boiler.

4. The apparatus of claim 3 further comprising a tubular boom that is deployable in a circular configuration, said boom having a plurality of ultrasonic transducers placed in an axially spiral configuration along the length of said boom.

5. The apparatus of claim 3 further comprising a boom having a plurality of radial arms, said boom being deployable in a fan-shaped configuration and having a plurality of ultrasonic transducers on each radial arm.

6. An apparatus for cleaning a boiler, said boiler having a plurality of interior surfaces and a plurality of interior heating tubes inside said boiler, said boiler have fluid at a predetermined level inside said boiler, comprising:

a plurality of surfaces, cracks and crevices on said heating tubes and the interior surfaces of said boiler, a plurality of ultrasonic transducers mounted on a multi-part deployable boom, each part of said boom including a sub-array of ultrasonic transducers, said boom being deployed inside said boiler so that the each part of said boom reaches into a different area of said boiler, especially around and near the plurality of surfaces, cracks and crevices on said heating tubes and the interior surfaces of said boiler, said plurality of ultrasonic transducers being simultaneously activated so that ultrasonic energy passes through the fluid and impinges on said interior surfaces, cracks and crevices with sufficient energy to dislodge and remove debris, accumulated deposits and sludge.

7. The apparatus of claim 6 further comprising a boom having two parallel arms, each arm including a plurality of ultrasonic transducers, wherein said transducers are simultaneously operable to dislodge deposits from the interior surfaces of said boiler.

8. The apparatus of claim 6 further comprising a tubular boom that is deployable in a circular configuration, said boom having a plurality of ultrasonic transducers placed in an axially spiral configuration along the length of said boom.

9. The apparatus of claim 6 further comprising a boom having a plurality of radial arms, said boom being deployable in a fan-shaped configuration and having a plurality of ultrasonic transducers on each radial arm.

* * * * *